US005288208A

United States Patent [19]

Cummins et al.

[11] Patent Number: 5,288,208

[45] Date of Patent: Feb. 22, 1994

[54] MARINE PROPELLER BLOCK APPARATUS

[76] Inventors: Richard L. Cummins, 435 Val La., Millville, N.J. 08332; Fred W. Devaney, 1564 W. Riverside Dr., Atlantic City, N.J. 08401

[21] Appl. No.: 69,744

[22] Filed: Jun. 1, 1993

[51] Int. Cl.[5] ..... B63H 1/14

[52] U.S. Cl. ..... 416/146 R; 416/5; 416/62; 440/74; 440/113

[58] Field of Search ..... 416/5, 146 R, 62, 247 A; 440/49, 74, 113; 292/343

[56] References Cited

U.S. PATENT DOCUMENTS

| | | | |
|---|---|---|---|
| 4,372,243 | 2/1983 | Roope, Jr. | 440/113 |
| 4,624,644 | 11/1986 | Hall | 416/146 R |
| 4,850,800 | 7/1989 | Zygutis | 416/146 R |

*Primary Examiner*—Edward K. Look
*Assistant Examiner*—James A. Larson
*Attorney, Agent, or Firm*—Leon Gilden

[57] ABSTRACT

A block structure of a generally trapezoidal configuration is interposed between a cavitation plate and propeller of a marine engine's lower unit to effect abutment of the propeller permitting loosening and removal of the associated propeller retaining nut member.

6 Claims, 4 Drawing Sheets

MARINE PROPELLER BLOCK APPARATUS

BACKGROUND OF THE INVENTION

1. Field of the Invention

The field of invention relates to propeller tool structure, and more particularly pertains to a new and improved marine propeller block apparatus permitting the abutting of a propeller relative to a marine outboard engine permitting removal of the associated propeller retaining nut.

2. Description of the Prior Art

Propeller accessory structure such as indicated in U.S. Pat. Nos. 3,732,033; 3,759,076; 3,981,617; 1981,165; and 4,538,962 are prior art examples of propeller lock structure.

The instant invention attempts to overcome deficiencies of the prior art by providing for a readily retrofit mount of propeller abutting structure permitting engaging the propeller and arresting rotation thereof to permit removal of the propeller retaining nut and in this respect, the present invention substantially fulfills this need.

SUMMARY OF THE INVENTION

In view of the foregoing disadvantages inherent in the known types of propeller locking structure now present in the prior art, the present invention provides a marine propeller block apparatus wherein the same is arranged to arrest rotation of a propeller relative to a marine outboard engine permitting ease of disassembly of a propeller relative to the engine structure. As such, the general purpose of the present invention, which will be described subsequently in greater detail, is to provide a new and improved marine propeller block apparatus which has all the advantages of the prior art marine propeller arresting structure and none of the disadvantages.

To attain this, the present invention provides a block structure of a generally trapezoidal configuration interposed between a cavitation plate and propeller of a marine engine's lower unit to effect abutment of the propeller permitting loosening and removal of the associated propeller retaining nut member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved marine propeller block apparatus which has all the advantages of the prior art marine propeller arresting structure and none of the disadvantages.

It is another object of the present invention to provide a new and improved marine propeller block apparatus which may be easily and efficiently manufactured and marketed.

It is a further object of the present invention to provide a new and improved marine propeller block apparatus which is of a durable and reliable construction.

An even further object of the present invention is to provide a new and improved marine propeller block apparatus which is susceptible of a low cost of manufacture with regard to both materials and labor, and which accordingly is then susceptible of low prices of sale to the consuming public, thereby making such marine propeller block apparatus economically available to the buying public.

Still yet another object of the present invention is to provide a new and improved marine propeller block apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
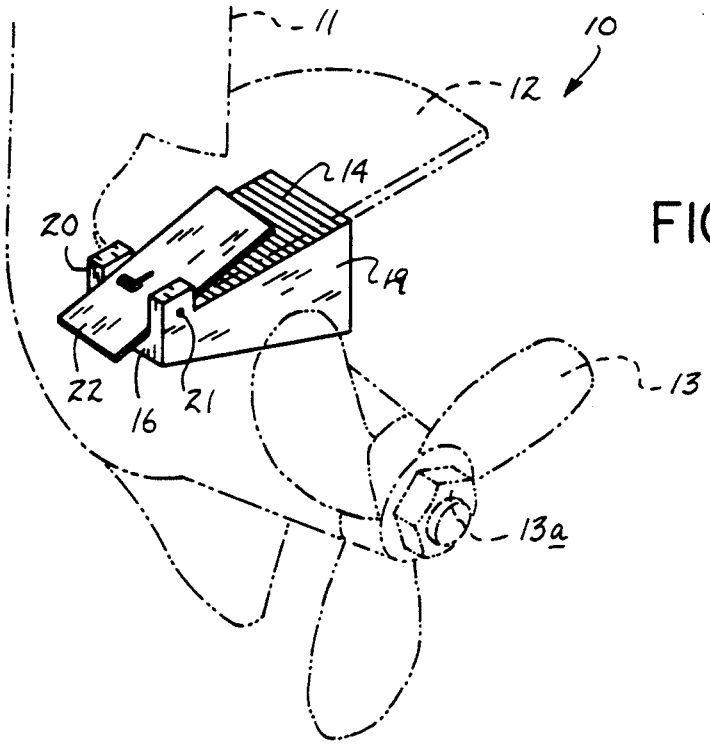
FIG. 1 is an isometric illustration of the invention.
Figure 2:
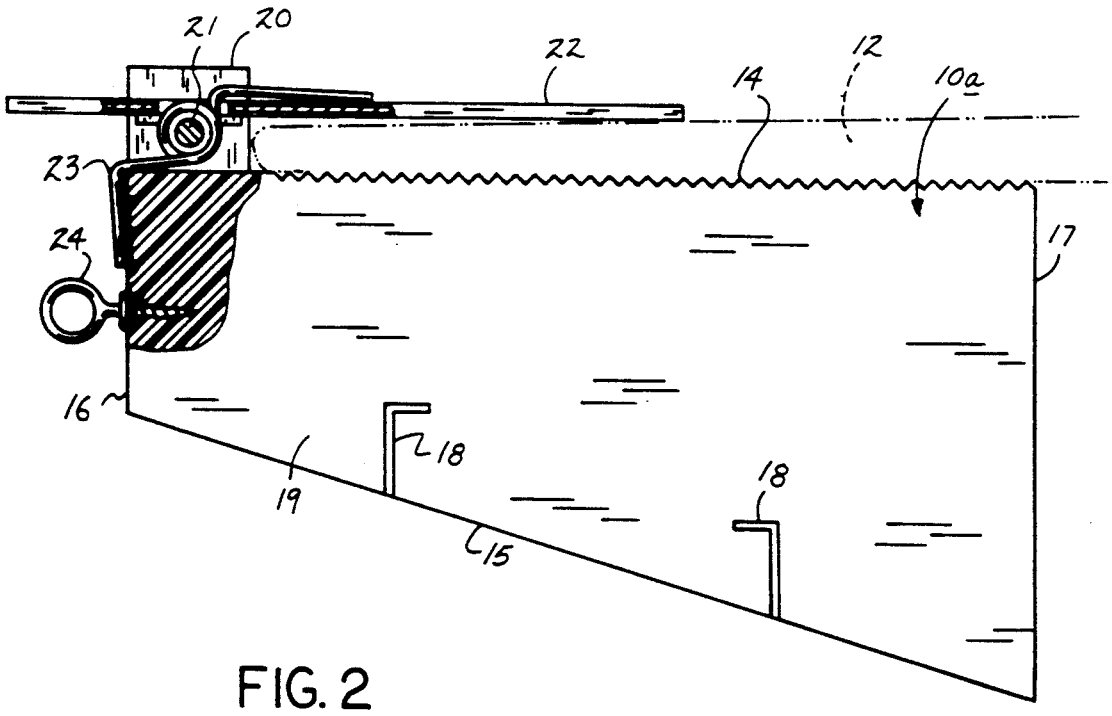
FIG. 2 is an orthographic frontal view of the invention, taken in elevation.
Figure 3:
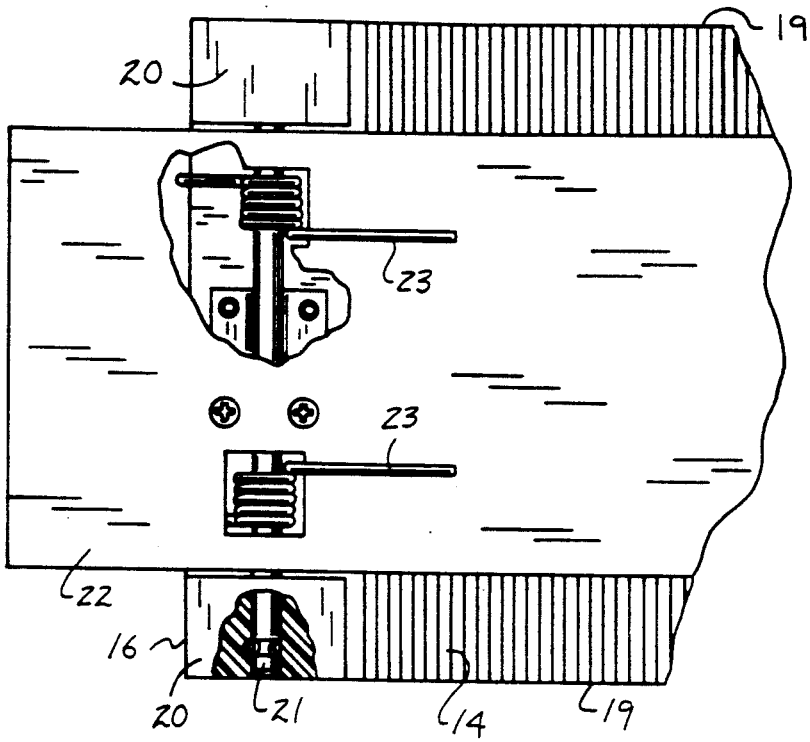
FIG. 3 is an orthographic top view, partially in section of the instant invention.
Figure 4:
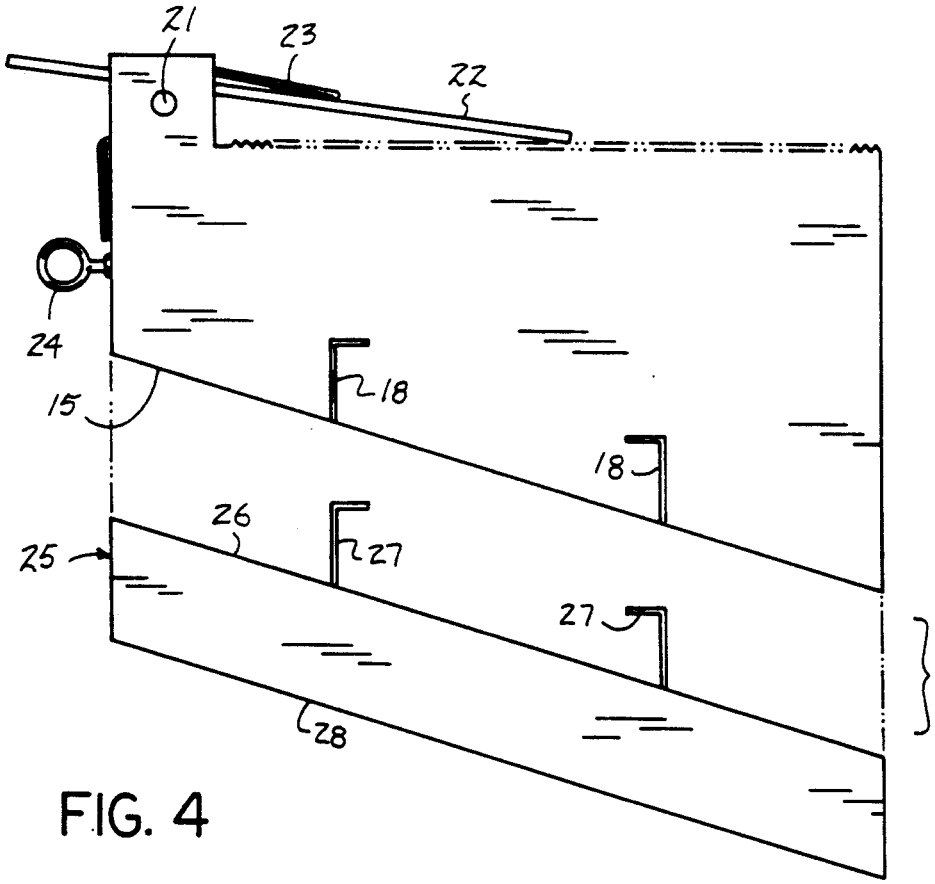
FIG. 4 is an orthographic view of the invention indicating the use of an accessory flange structure mounted to the bottom wall of the block.
Figure 5:
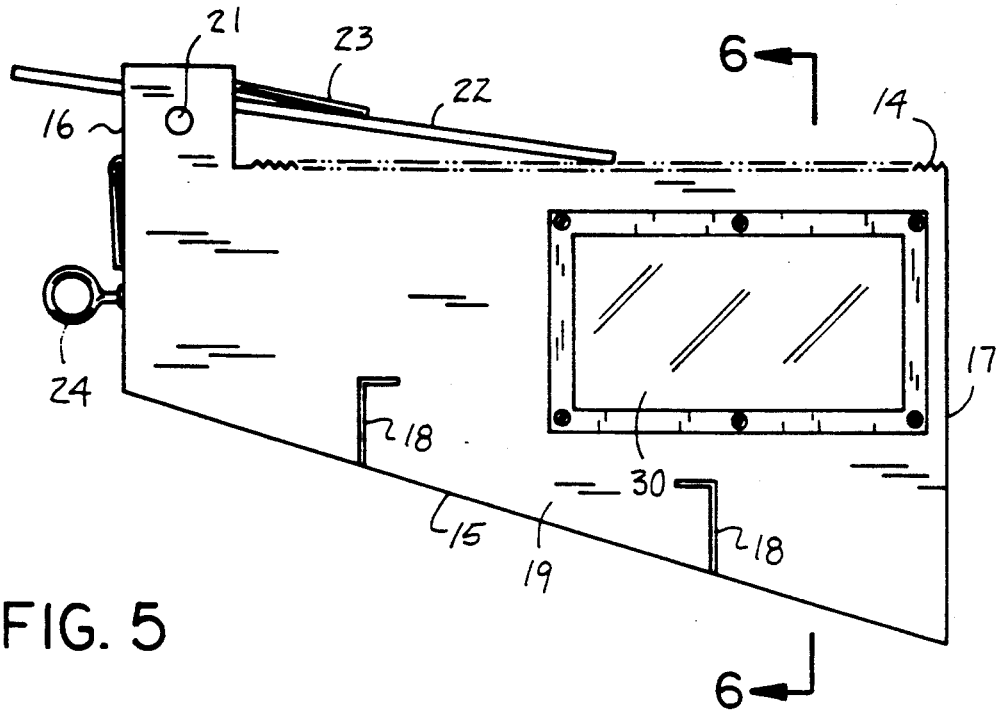
FIG. 5 is an orthographic view of the block member, including illumination means therewithin.

With reference now to the drawings, and in particular to FIGS. 1 to 8 thereof, a new and improved marine propeller block apparatus embodying the principles and concepts of the present invention and generally designated by the reference numeral 10 will be described.

More specifically, the marine propeller block apparatus 10 of the instant invention essentially comprises cooperation with marine engine lower unit 11, having a cavitation plate 12 spaced from a rotating propeller 13, having a plurality of blades as illustrated in FIG. 1, including a propeller nut 13*a* to secure the propeller 13 relative to the shaft. The apparatus is arranged to include a block member 10*a*, having a top wall 14 spaced from a bottom wall 15, with respective first and second end walls 16 and 17. The bottom wall 15 is oriented at an obtuse included angle relative to the first end wall 16, and at an acute included angle relative to the second end wall 17 to define a generally tapezoidal configured block member 10*a*. Spaced block side walls 19 are provided to position the block member between the cavitation plate 12 and the blades of the propeller 13 to effect abutment with the blades preventing their rotation. To secure the block member 10*a* to the cavitation plate 12, a clamp plate 22 is provided pivotally mounted about an axle 21 between spaced support flanges 20 projecting orthogonally from the top wall 14 in adjacency to the first end wall 16, and to include spring members 23 to bias the clamp plate 22 towards the top wall 14. A tether loop 24 is also provided fixedly mounted to and projecting from the first end wall 16 permitting mounting of a tether line from the first end wall 16 to an anchor point relative to an associated boat or to the engine assembly itself preventing loss of the apparatus particularly when the apparatus is employed with the engine over or within a body of water, such as typically such repairs are of an emergency type need.

It should also be noted that a plurality of generally L-shaped slots 18 are directed into the bottom wall 15 arranged to receive engaging flanges 27 complementarily therewithin. The engaging flanges 27 are mounted to an extension plate top wall 26 of an extension plate 25, with the extension plate including a spaced parallel extension plate bottom wall 28. In this manner, extension of an effective height of the side walls 19 is effected in the event that the "cut water clearance" or the spacing between the propeller blades and the apparatus is such that the apparatus will engage for purposes of abutment, the propeller blades onto either the block bottom wall 15 or the extension plate bottom wall 28 should the extension plate be employed.

Figure 6:
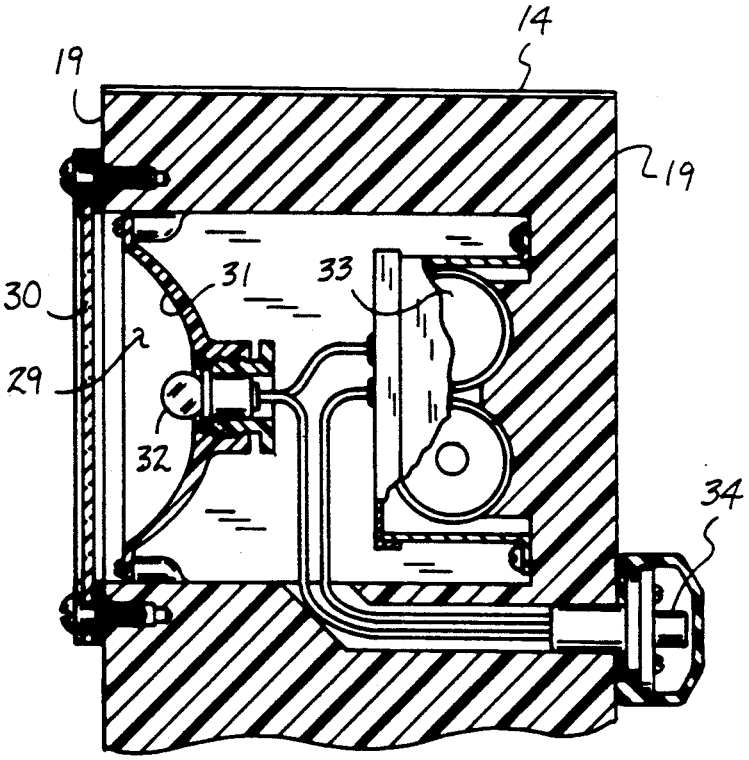
FIG. 6 is an orthographic view, taken along the lines 6—6 of FIG. 5 in the direction indicated by the arrows.

The FIG. 6 indicates the block member incorporating a block cavity 29 within the block member such that a transparent lens 30 projects through one of said side walls 19 in communication with the cavity 29. A reflector 31 is positioned in adjacency and in facing relationship relative to the lens 30, having a bulb 32 in electrical communication through batteries 33 and a switch 34. The switch 34 is typically of a water-proof type construction, whereupon actuation or closure of the switch 34 effects illumination of bulb 32 to provide for illumination, particularly during conditions when the lower unit is below water level and enhanced illumination is desired during periods of limited available light.

Figure 7:
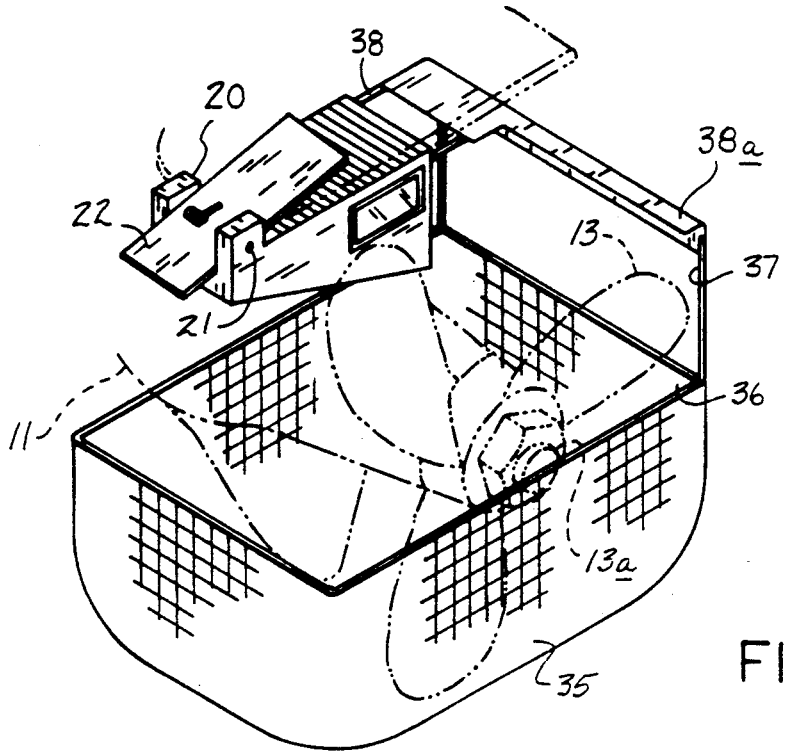
FIG. 7 is an isometric illustration of the invention incorporating an underlying basket structure.
Figure 8:
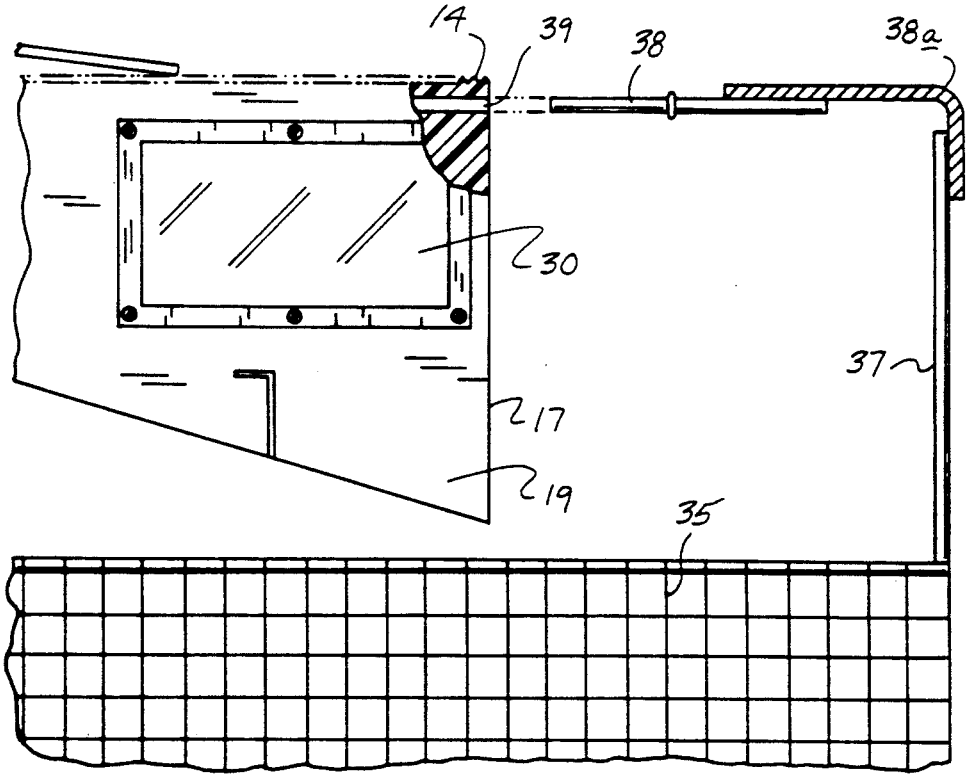
FIG. 8 is an orthographic illustration of the invention, partially in section, indicating mounting of the basket structure relative to the block.

The FIGS. 7 and 8 illustrates the use of a basket member 35 arranged for mounting below the propeller 13 to prevent loss of the propeller nut 13*a* or other components during working upon the lower unit, and particularly the propeller in its removal. The basket member 35 includes a basket side wall 36, including a plurality of support rods 37 extending therefrom in a coplanar relationship, such that a connecting web 38*a* mounted to the support rods 37 spaced from the side wall 36 incorporates mounting rods 38 orthogonally oriented relative to the support rods 37, wherein each of the mounting rods 38 is received within one of a plurality of rod bores 39 directed into the second end wall 17 to provide for positioning of the basket below the propeller and the engine lower unit 11.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A marine propeller block apparatus arranged for mounting to a cavitation plate of a marine engine lower unit, wherein the apparatus comprises, a wedge member of rigid construction, having a top wall arranged to engage the cavitation plate, and a bottom wall, wherein the bottom wall is oriented at an oblique angulation relative to the top wall and coextensive with the top wall, with the wedge member including a first end wall spaced from a second end wall, and spaced side walls, wherein clamp means is mounted to the top wall in adjacency to the first end wall for securing the cavitation plate between the clamp means and the top wall.

2. An apparatus as set forth in claim 1 wherein the clamp means includes a plurality of spaced support flanges fixedly mounted to the top wall in adjacency to the first end wall, and an axle directed through the support flanges, and a clamp plate pivotally mounted about the axle, with the clamp plate including at least one spring member wound about the axle and secured to the clamp plate to bias the clamp plate in a contiguous communication with the top wall.

3. An apparatus as set forth in claim 2 including a tether loop mounted to the wedge member permitting securement of the wedge member relative to the engine lower unit.

4. An apparatus as set forth in claim 3 wherein the bottom wall includes a plurality of bottom wall slots and an extension plate, the extension plate having an extension plate top wall spaced from an extension plate bottom wall, wherein the extension plate top wall and the extension plate bottom wall are arranged in a spaced parallel relationship, with the extension plate top wall further including a plurality of engaging flanges, with each of the engaging flanges arranged for complementary reception with one of said slots.

5. An apparatus as set forth in claim 4 wherein the wedge member includes a cavity therewithin, and a transparent lens mounted to one of said side walls, including a reflector mounted within the cavity in adjacency and facing relationship relative to the transparent lens, and an illumination bulb mounted medially of the reflector, and at least one battery member, and a switch in electrical communication with the illumination bulb to provide for selective illumination of the illumination bulb within the cavity to direct illumination through the transparent lens.

6. An apparatus as set forth in claim 5 including a basket member, the basket member including at least one basket member side wall, wherein the basket member side wall includes a plurality of support rods, the support rods including a connecting web and a plurality of mounting rods, the mounting rods fixedly mounted to the connecting web orthogonally oriented to the support rods, and the second end wall includes a plurality of rod bores, wherein each of the mounting rods are arranged for reception within one of said rod bores, with the basket member oriented below and in a spaced relationship with the bottom wall of said wedge member.

* * * * *